US006513249B2

(12) United States Patent
Linton et al.

(10) Patent No.: US 6,513,249 B2
(45) Date of Patent: Feb. 4, 2003

(54) FLUTE KNIFE

(75) Inventors: W. Stewart Linton, Downsview (CA); Mario Romero, Scarborough (CA); Beverly Norton, Downsview (CA); Rae Townsend, Downsview (CA)

(73) Assignee: EM Plastic & Electric Products Ltd., Downsview (CA)

( * ) Notice: Subject to any disclaimer, the term of this patent is extended or adjusted under 35 U.S.C. 154(b) by 0 days.

(21) Appl. No.: 09/742,226

(22) Filed: Dec. 22, 2000

(65) Prior Publication Data

US 2002/0078572 A1 Jun. 27, 2002

(51) Int. Cl.[7] ..... B26B 29/00

(52) U.S. Cl. ..... 30/286; 30/294; 30/287; 30/2

(58) Field of Search ..... 30/194, 286, 287, 30/289, 304, DIG. 3, 279.2, 2, 294, 131

(56) References Cited

U.S. PATENT DOCUMENTS 920,409 A * 5/1909 Wild ..... 30/289
1,546,975 A * 7/1925 Feller ..... 30/286
1,562,429 A * 11/1925 Unsinger ..... 30/2
3,673,687 A * 7/1972 Phillips et al. ..... 30/294
4,167,810 A * 9/1979 Gilbert ..... 30/294
4,198,751 A * 4/1980 Egbert ..... 30/286
4,833,956 A * 5/1989 Roberts ..... 30/287
5,122,152 A * 6/1992 Mull ..... 30/294
5,447,516 A * 9/1995 Gardner ..... 30/304
5,625,951 A * 5/1997 Hamlin ..... 30/146
5,826,342 A * 10/1998 Zuro ..... 30/279.2
6,029,355 A * 2/2000 Carlin ..... 30/304
6,182,364 B1 * 2/2001 Reyburn ..... 30/2
6,195,896 B1 * 3/2001 Ireland ..... 30/2
6,240,645 B1 * 6/2001 Ozeki ..... 30/294

* cited by examiner

*Primary Examiner*—Kenneth E. Peterson
*Assistant Examiner*—Omar Flores Sánchez

(57) ABSTRACT

A flute knife for cutting of corrugated plastic sheet includes a handle, a blade shank, two cutting edges and a pair of elongate guide members. The blade shank has a projecting end portion and the cutting edges are located on the projecting end portion and face rearwardly. One elongate guide member is located adjacent a free edge of the blade shank and the other guide member is located between the cutting edges. The handle and the guide members are preferably of a plastic material molded onto the metal blade shank.

9 Claims, 4 Drawing Sheets

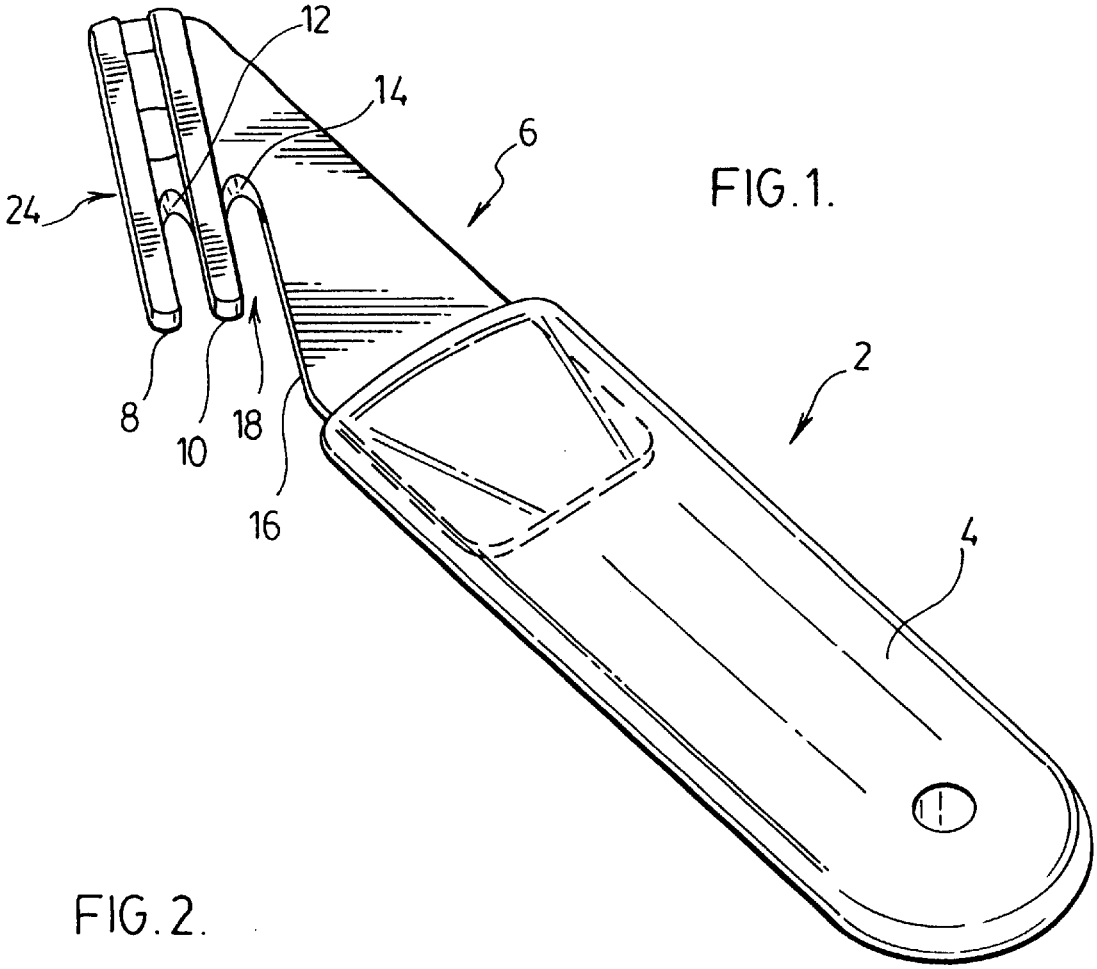
FIG. 1.
FIG. 2.
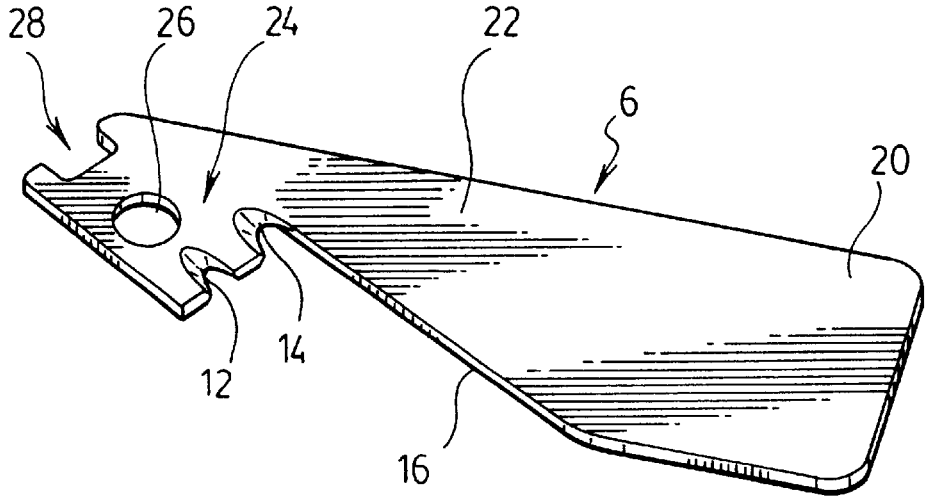

FLUTE KNIFE

FIELD OF THE INVENTION

The present invention relates to utility knives, and in particular, relates to utility knives for cutting corrugated plastic sheets.

BACKGROUND OF THE INVENTION

Corrugated plastic sheet basically is sold by a number of different manufacturers and comprises two opposed plastic sheet layers connected by a series of small elongate webs. Corrugated plastic sheet is most commonly used as an inexpensive substrate for temporary signs such as election signs or other similar applications. For some applications, it is necessary to trim the substrate to a particular size and the substrate is typically cut between the parallel webs. It may also be necessary to cut across the webs to effect trimming at the end of the substrate (cross-cut).

Corrugated plastic sheet is not limited to flat applications and in some cases, it is desirable to cut the sheet on only one side thereof to allow the second layer to form a live hinge.

Hook shaped knives for pulling through plastic sheet or foam sheet are known and it is also known to have a knife with two cutting surfaces and two guides for cutting of corrugated plastic sheet. This latter knife is of a complicated design in that the guides are mechanically fastened to a central member and the product is expensive to manufacture.

SUMMARY OF THE INVENTION

A flute knife according to the present invention comprises a handle, a blade shank and a pair of elongate guide members. The blade shank extends from one end of the handle and has a projecting portion at a free end of the blade shank. The projecting portion includes two separate rearwardly facing cutting edges. The cutting edges are separated from each other by one of the pair of elongate guide members with the other elongate guide member being located at a forward face of the blade shank. The blade shank is of a metal material and the guides are of a plastic material and partially encase a limited portion of the blade shank.

According to an aspect of the invention, the guide members are integrally connected.

According to yet a further aspect of the invention, the guide members extend in a parallel-like manner beyond the blade shank and extend across the blade shank on both sides of the blade shank.

According to a further aspect of the invention, the guide members are integrally connected and include a connecting portion that extends through the blade shank.

According to yet a further aspect of the invention, the blade shank includes a notched top edge portion and the guide members are integrally connected within the notched top edge.

In a further aspect of the invention, the guide members are injected molded onto the blade shank.

According to yet a further aspect of the invention, the guide members and the handle portion are injected molded onto the blade shank and are of a nylon material.

BRIEF DESCRIPTION OF THE DRAWINGS

Preferred embodiments of the invention are shown in the drawings, wherein:

FIG. 1 is a perspective view of the utility knife;

FIG. 2 is a perspective view of the blade shank;

DETAILED DESCRIPTION OF THE PREFERRED EMBODIMENTS

Figure 4:
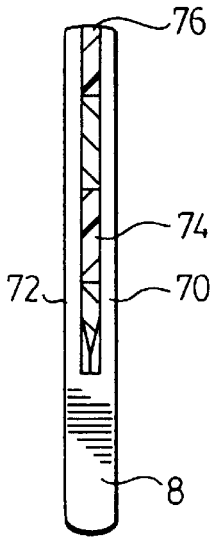
FIG. 4 is a sectional view taken along line A—A of FIG. 3.

The flute knife 2 includes an elongate nylon handle with a forward and a rearward end. The handle 4 is molded onto the blade shank 6 such that the blade shank extends from the forward end. The blade shank is ground to include two crescent like cutting edges 12 and 14 in the projecting end portion 24 of the blade shank. Each of these crescent cutting edges has been ground on opposite sides of the blade shank. The blade shank is preferably of a spring metal material. An outside guide member 8 extends beyond the blade shank and is generally parallel with the inside edge 16 of the blade shank and the edge of the handle 4. This outside guide member acts as a guard and limits access to the crescent cutting edges. An inside guide member 10 is positioned between the crescent cutting edges 12 and 14 and is parallel to the outside guide member 8. These guide members extend either side of the blade shank and preferably have a thickness marginally less than the space between opposed web members of the corrugated sheet. These guide members can slide along one of the webs of the corrugated sheet to assist in producing a straight cut. There is a substantial gap 18 between the inside guide member 10 and the inside edge 16 of the blade shank. This allows convenient cross cutting of 4 mm thick corrugated polypropylene sheet and also allows cross cutting of 10 mm thick polypropylene sheet. The guides are primarily designed for use with the 4 mm thick polypropylene sheet but the knife has application for thicker sheets. These thicker sheets are less common but are used where additional structural strength or durability is required.

The blade shank 6, as shown in FIG. 2 has a securing portion 20 which is buried in the handle 14. Preferably, the handle is directly molded onto the blade shank and the handle encases the securing portion 20. The blade shank includes a tapered intermediate section 22 which terminates in a projecting end 24. The projecting end 24 includes the two crescent cutting edges 12 and 14 as well as the port 26 and the notched end 28. The port 26 and the notched end 28 each form a passage through the blade shank. The punched port 26 and the notched end 28 assist in the attachment of the guide members 12 and 14 to the projecting end of the blade shank. The guide members are injected molded onto the blade shank and the guide members are of a plastic material.

This plastic material fills the port 26 and also fills the notched end 28 of the projecting end of the blade shank. The plastic in the notched end and in the port 26 integrally connects each of the guide members. The plastic in the notched end and in the port 26 is of the approximate thickness of the blade shank 6. The guides extend above the surface and below the surface of the blade shank, however, the guides are integrally connected. This securement arrangement connects the two guides and improves the securement of the guides to the blade shank.

As shown in FIG. 2, the blade shank terminates generally adjacent the crescent cutting edges 12 and 14 and as such, the guides 12 and 14 extend beyond the blade shank.

It has been found that the injection molding of the handle and the guide members directly onto the blade shank allows the utility knife to be manufactured in a cost effective manner. It greatly simplifies the securement of the guide members to the blade shank. These portions are preferably molded of a nylon material which provides strong adherence and toughness, and also has demonstrates a low coefficient of friction with polypropylene material which is the normal material of the corrugated plastic sheet.

Figure 3:
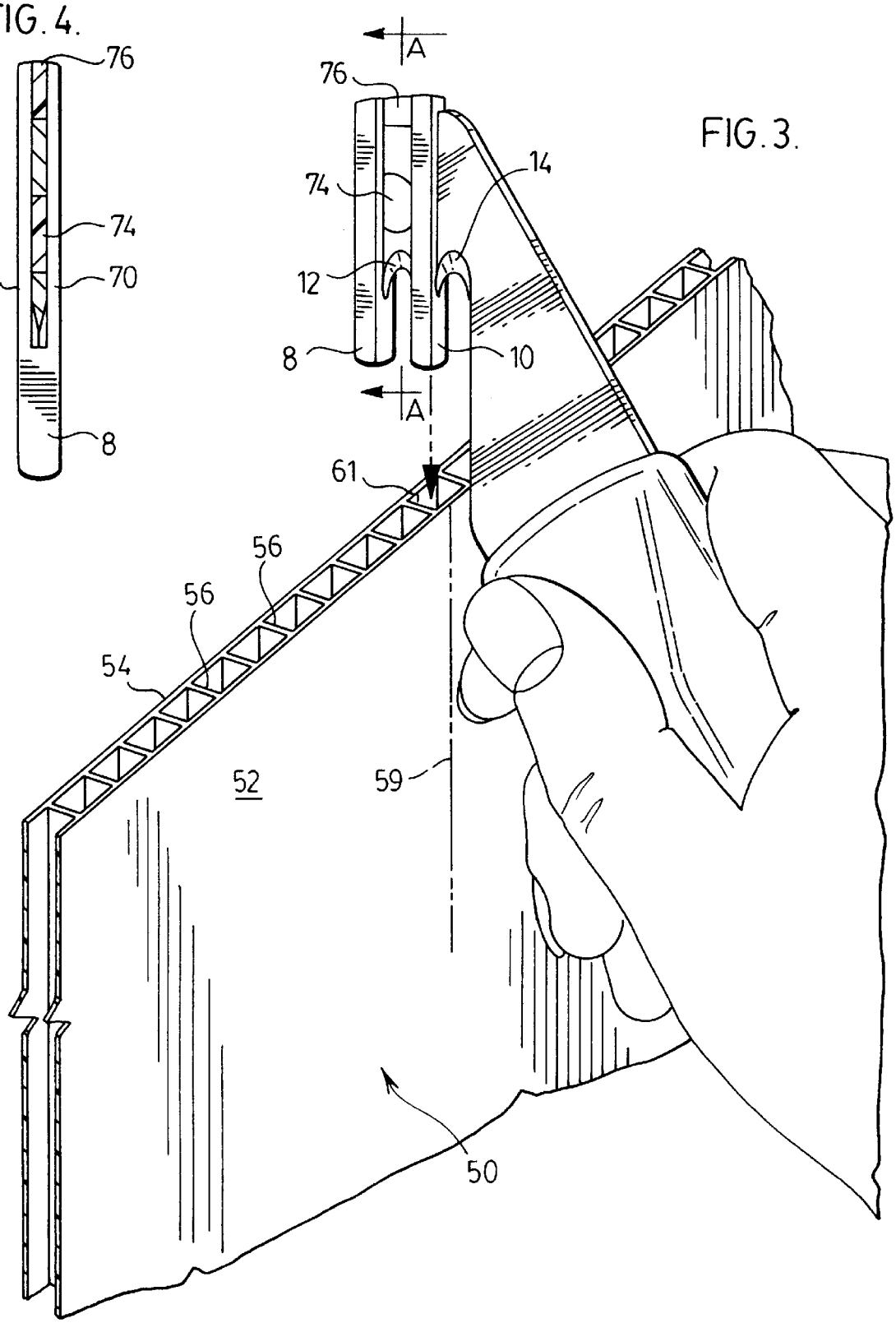
FIG. 3 is a partial perspective view showing the knife being positioned for cutting of both sides of the corrugated plastic sheet.

FIG. 3 shows the flute knife 2 aligned for cutting of the corrugated plastic sheet 50. This plastic sheet 50 includes layer 52 connected to the opposed layer 54 by the series of webs 56. The guides 8 and 10 are sized for insertion in the gaps between the webs with guide 10 about to be inserted in one such gap. The guide 10 as shown in FIG. 3 will abut with the web 56 and the web can act as a straight edge for cutting of the plastic sheet. The proposed cut line is shown as 59 on layer 52 and 61 on layer 54. Any wandering of the cut line is limited to the extent that the guides can be angled.between the two webs.

The sectional view of FIG. 4 shows the attachment of the guides to the blade shank. Guide 8 projects beyond the blade shank and ha-s two strip portions 70 and 72 either side of the blade shank which are connected by the plastic portion 74 within the port 26 and by the plastic portion 76 located in the notched end region 28. This connection arrangement provides positive securement of the two guides to the blade shank and simplifies the securement thereof. The extension of the guide members 8 and 10 beyond the blade shank form guards such that the actual crescent cutting edges 12 and 14 are in protected regions and present little hazard to the user.

Figure 5:
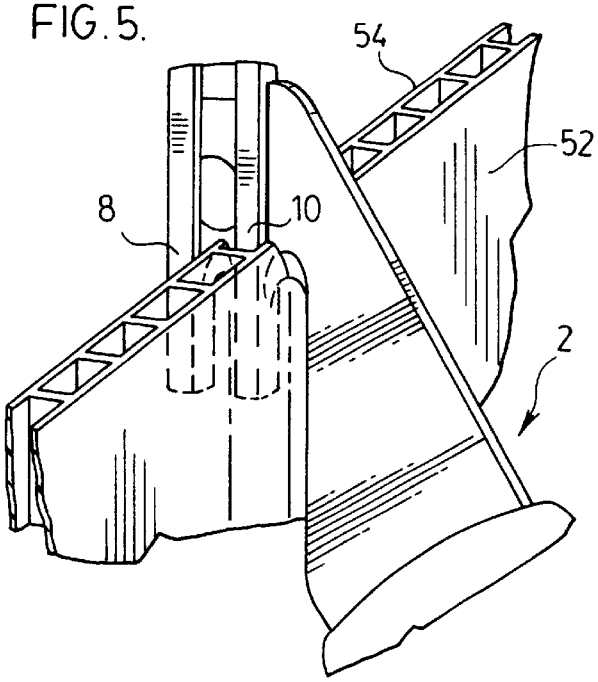
FIG. 5 shows the flute knife cutting both sheets of the corrugated plastic between web members.
Figure 7:
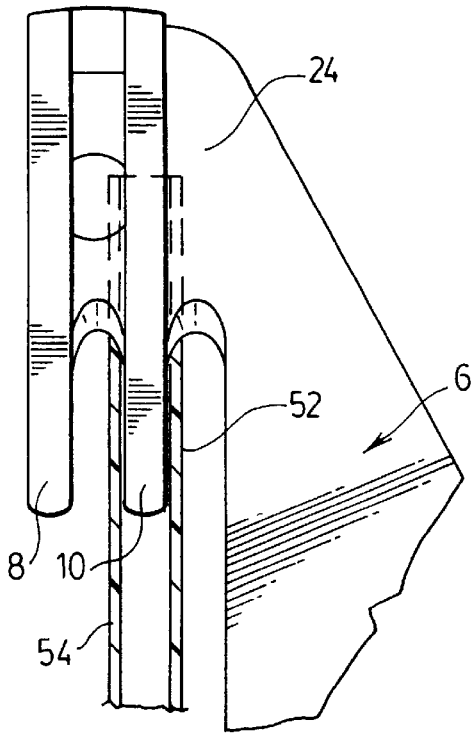
FIG. 7 is a sectional view showing the knife of FIG. 5 cutting a corrugated plastic sheet.

FIG. 5 and FIG. 7 show the flute knife 2 cutting both plastic layers 52 and 54 of the corrugated sheet 50.

Figure 6:
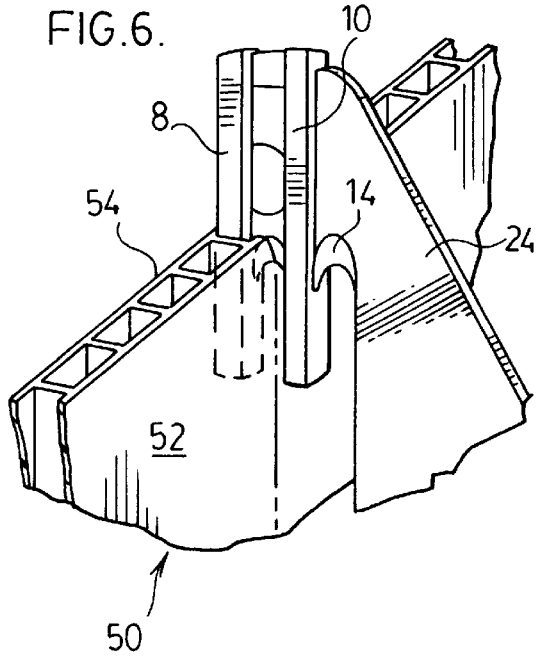
FIG. 6 is a partial perspective view showing the flute knife cutting one of the sheet members between opposed web members.
Figure 8:
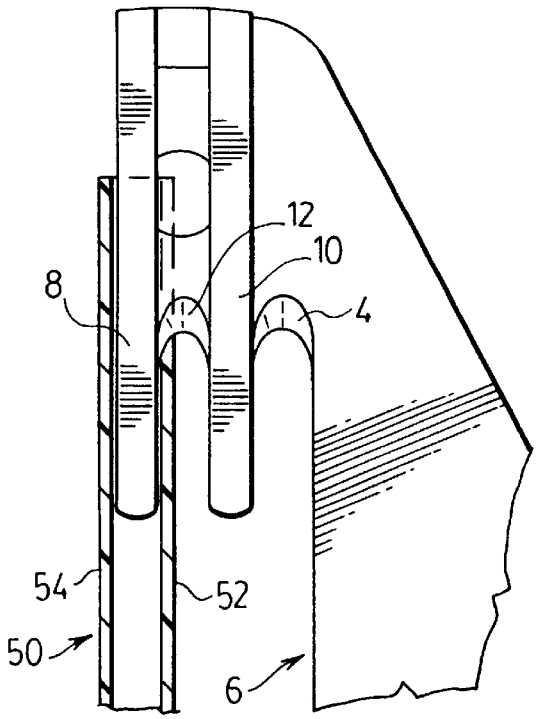
FIG. 8 is a sectional view of the utility knife cutting a single wall of the corrugated plastic as shown in FIG. 6.

In FIGS. 6 and 8, the guide 8 is captured between two opposed webs and only layer 52 is being cut.

Figure 9:
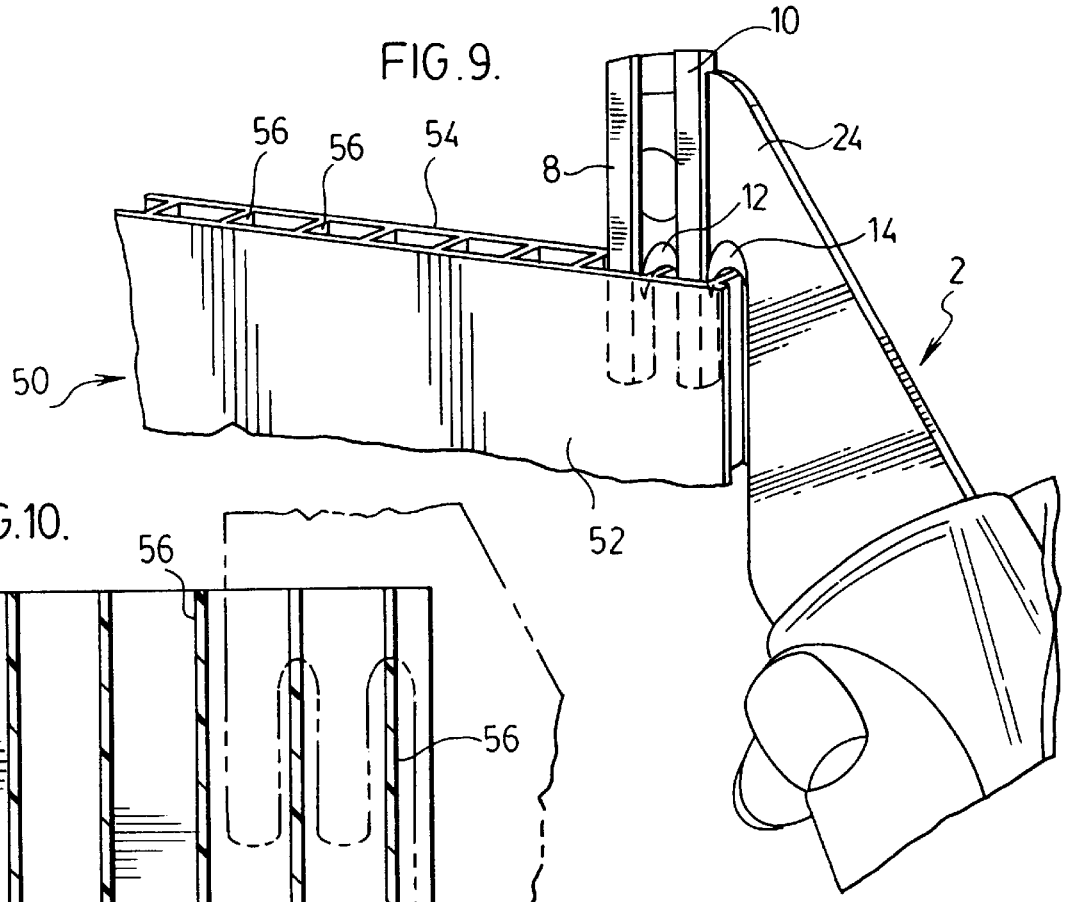
FIG. 9 is a partial perspective view showing the utility knife cutting two web members at the edge of a plastic sheet.
Figure 10:
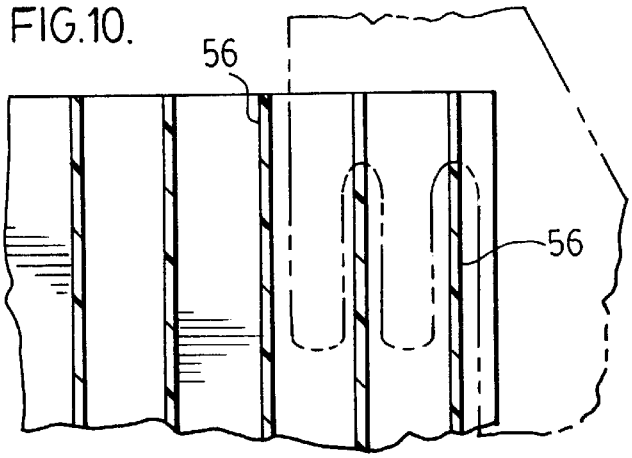
FIG. 10 is a sectional view showing the cutting action of FIG. 9.

FIGS. 9 and 10 show cutting of two webs 56 at an end of the corrugated sheet.

Figure 11:
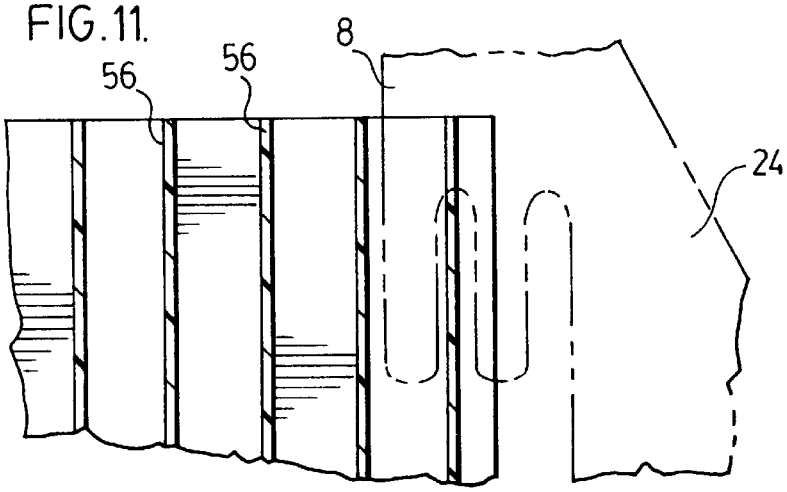
FIG. 11 is a sectional view showing the utility knife cutting a single web member at the end of a plastic sheet.

FIG. 11 shows cutting of a single web 56 at an end of the sheet.

The flute knife as described includes an injection molded plastic handle which is molded at the same time as the guide members 8 and 10 are molded onto the blade shank 6. The blade shank has been previously processed to grind the particular cutting edges and to shape the blade shank.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A flute knife for cutting corrugated plastic sheet comprising an elongate handle having a forward end and a rearward end, a flat metal blade shank extending from said forward end of said handle, said flat metal blade shank having a projecting portion with a rearwardly facing edge to one side of and at an angle to said elongate handle, said projecting portion having at least one securing passage extending through said flat metal blade shank; a pair of plastic parallel elongate guide members molded onto said projecting portion with said guide members extending through and securely engaging said at least one securing passage to fix said guide members to said blade shank; said pair of plastic guide members extending beyond said rearwardly facing edge and beyond said blade shank; each of said elongate guide members extending across said projecting portion on opposite sides thereof with said blade shank partially encased in said guide members, said rearwardly facing edge including an outer cutting edge and an inner cutting edge separated from each other by one of said elongate guide members with the other guide member being immediately adjacent said outer cutting edge.

2. A flute knife as claimed in claim 1 wherein said guide members are integrally connected in said at least one securing passage.

3. A flute knife as claimed in claim 1 wherein said guide members and said handle are injected molded onto said blade shank.

4. A flute knife as claimed in claim 1 wherein said at least one securing passage includes a port and said guide members are integrally connected and include a connecting portion that extends through said port in said blade shank.

5. A flute knife as claimed in claim 4 wherein said at least one securing passage includes a notched top edge and said guide members are integrally connected within said notched top edge.

6. A flute knife as claimed in claim 5 wherein said guide members and said handle are injected molded onto said blade shank.

7. A flute knife as claimed in claim 6 wherein said guide members are of a nylon material.

8. A flute knife as claimed in claim 6 wherein said guide members are of a plastic material having a low coefficient of friction relative to polypropylene.

9. A flute knife as claimed in claim 6 wherein said blade shank is of a spring steel.

* * * * *